US006006927A

United States Patent [19]

Levy

[11] Patent Number: 6,006,927

[45] Date of Patent: Dec. 28, 1999

[54] PAINT CHIP DISPLAY SYSTEM

[76] Inventor: Raymond H. Levy, 976 Rector Rd., Bridgewater, N.J. 08807

[21] Appl. No.: 09/097,188

[22] Filed: Jun. 12, 1998

[51] Int. Cl.[6] ..... A47F 7/00

[52] U.S. Cl. ..... 211/51; 211/50; 211/55; 40/124.2

[58] Field of Search ..... 40/124, 124.2; 211/40, 50, 55, 51, 126.2, 128.1, 88.01; 312/50, 61

[56] References Cited

U.S. PATENT DOCUMENTS 4,102,072 7/1978 Buschman .

4,532,727 8/1985 Klose et al. .

5,312,001 5/1994 Sorensen .

*Primary Examiner*—Robert W. Gibson, Jr.

*Attorney, Agent, or Firm*—Arthur L. Plevy

[57] ABSTRACT

A paint chip display device including a rectangular container having: a rectangular rear wall having a front surface and a back surface; an oppositely disposed open front face; oppositely disposed upper and lower walls, coupled between said rear wall and said front face; oppositely disposed left-side and right-side walls, coupled between said rear wall and said front face; retaining means for retaining paint chips contained within a cavity formed by said rear, upper, lower, left-side and right-side walls; and, biasing means for biasing paint chips contained within said cavity away from said rear wall and toward said open front face.

26 Claims, 10 Drawing Sheets

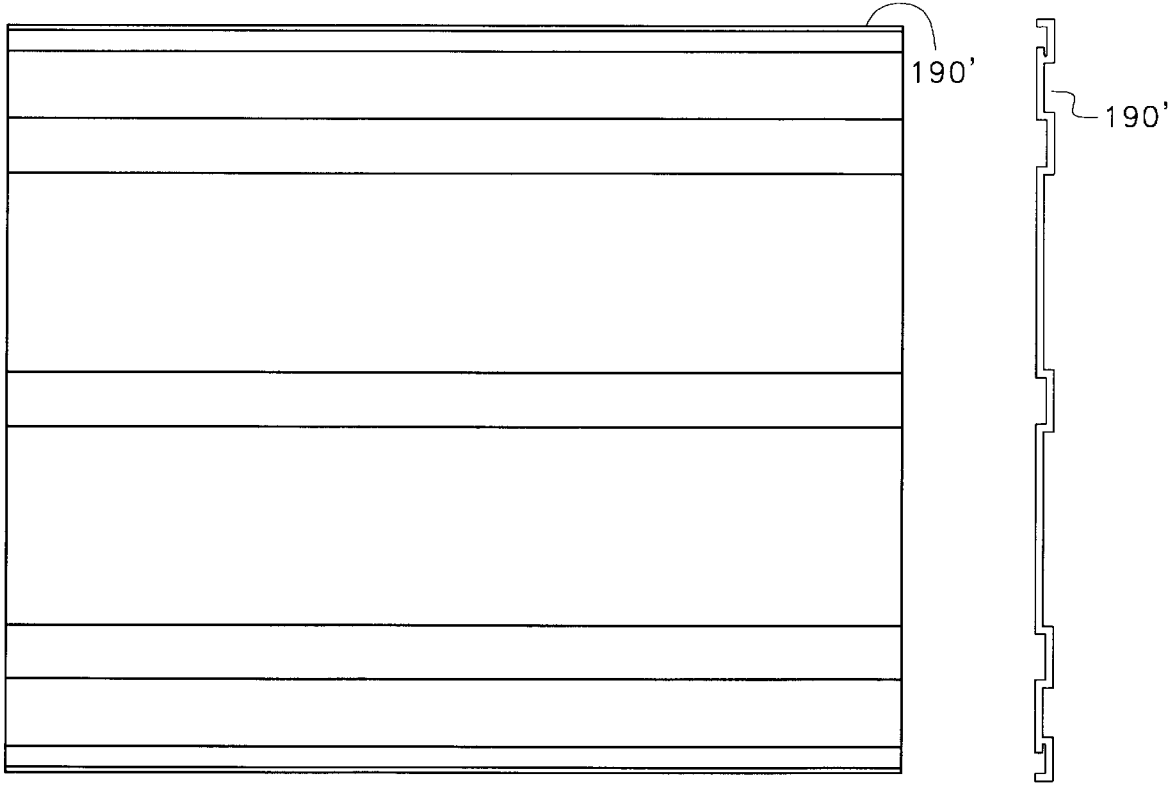
Fig. 6D
Fig. 6A
Fig. 6B
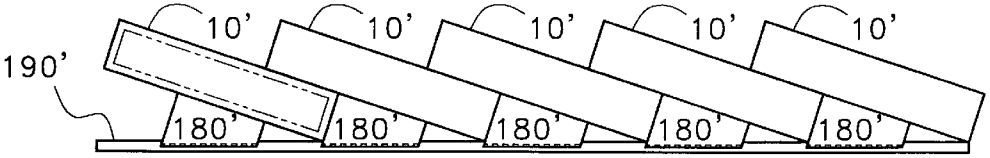
Fig. 6C

PAINT CHIP DISPLAY SYSTEM

FIELD OF INVENTION

The current invention relates to display structures and more particularly to paint chip display structures used in the sale of paints.

BACKGROUND OF INVENTION

In the marketing of paint it is desirable to provide paint chips to prospective paint customers demonstrating different colors and surface finishes corresponding to the effects obtained by using the different colors and types of paint being marketed. Such paint chips can typically be characterized as small pieces of heavy paper or cardboard having a finish on a front surface corresponding to at least one paint and color intended to be represented thereby. Display of such paint chips typically involves the use of suitable stands or display devices permitting a prospective paint customer to select one or more paint chips representative of the paint and color he wishes to purchase.

It is desirable to display such paint chips in close proximity to each other, in a stacked manner, to allow a prospective paint purchaser to concurrently compare various colors and finishes of the varying paints, while simultaneously being able to remove a paint chip revealing another paint chip representative of the same paint and color as represented by the removed paint chip.

One such device can be seen in the Crosslen patent (U.S. Pat. No. 4,265,038). The Crosslen device has disadvantages in common with other typical paint chip display devices.

One main disadvantage of typical paint chip display devices such as Crosslen lies in the inability to either configure the display to allow for exhibition of the full face of each stack of paint chips displayed therein, or to allow for an overlapping configuration to decrease the required area for the display. It is desirable to display the greatest portion of the front face of each paint chip stack as is possible, given the structural limitations of the display area. Typical devices, such as Crosslen, obscure significant portions of each paint chip stack in a way such that they are not readily viewable by a prospective paint customer, and do not give the displayor the option of displaying the entire front face of each paint chip if so desired.

Another main disadvantage of typical paint chip display devices lies in the positioning of the paint chips within the display itself. Typical devices, such as that disclosed in Crosslen, fail to adequately protect paint chips contained therein, as a portion of each paint chip typically protrudes beyond the confines of the device. Accordingly, display devices such as this allow paint chips to warp or disform with time. Further, display devices of this kind often allow paint chips displayed therein to sag within the device, thus also causing them to warp or disform. This warping of the paint chips is highly disadvantageous in the sale of paints, and may require the frequent replacement of otherwise unused paint chips.

Furthermore, the relative angle at which paint chips are stored within a typical display device, such as Crosslen, with regard to a prospective paint purchaser, is typically not conducive to allowing a prospective paint customer to easily and accurately judge the color and finish of a selected paint chip, as the faces of the paint chips are often angled downward, or toward the floor.

A further known disadvantage of typical paint chip displays is the relatively high cost and difficulty of assembly of the display itself, as a typical display includes extensive cabinetry requiring a relatively large amount of floor space. Additionally, such devices are heavy presenting storage and shipping problems.

Also, such devices are typically limited in their ability to be modified to represent additional or fewer paint colors.

Disadvantages of other typical paint chip display devices is the ability of the customer to remove the last paint chip of a select color and finish, necessitating the supply of paint chips thereof to be replenished before another prospective customer may view a paint chip corresponding to the previous exhausted supply. Accordingly, it is desirable to display a permanent paint chip, corresponding to each stack of paint chips representative of a paint and color which is non removable and adequately protected from attempted removal by a prospective paint customers.

Accordingly, it is an object of the invention to provide a paint chip display device which allows for many paint chips full faces to be simultaneously displayed to a prospective paint customer. It is a further object of the invention to provide a paint chip display device which prevents paint chips contained therein from warping or disforming with time.

It is a further object of the invention to provide a paint chip display device, which prevents a prospective customer from removing the last paint chip of a select color and finish.

It is further objects of the invention to reduce the required floor space of the device by eliminating extensive cabinetry, and surface area of a given paint chip display by allowing the paint chip display to be easily modified to include space for only those paint chips which the displayor presently wishes to display. And, to provide a paint chip display device with a relatively low cost and ease of assembly of the device itself.

SUMMARY OF THE INVENTION

A paint chip display device comprising a rectangular container comprising: a rectangular rear wall having a front surface and a back surface; an oppositely disposed open front face; oppositely disposed upper and lower walls, coupled between said rear wall and said front face; oppositely disposed left-side and right-side walls, coupled between said rear wall and said front face; retaining means for retaining paint chips contained within a cavity formed by said rear, upper, lower, left-side and right-side walls; and, biasing means for biasing paint chips contained within said cavity away from said rear wall and toward said open front face.

BRIEF DESCRIPTION OF FIGURES

FIG. 6A is a front view of a preferred embodiment of an extrusion to which the alternative embodiment of the paint chip display pocket of FIG. 5 can be mounted to.

FIG. 6B is a side view of an alternative embodiment of a paint chip display pocket according to the present invention.

FIG. 6C is a bottom view of the alternative embodiment of the paint chip display pocket of FIG. 5 mounted to the preferred extrusion of FIG. 6A.

FIG. 6D is a side view of the preferred embodiment of the extrusion of FIG. 6A.

DETAILED DESCRIPTION OF THE INVENTION

The present invention relates to a paint chip display system comprised of a plurality paint chip display pockets and extrusions for securing the pockets to a surface. Each pocket is capable of individually displaying a plurality of like stacked paint chips corresponding to at least one color and finish of a paint intended to be represented thereby itself.

In a preferred embodiment, each pocket of said plurality may be coupled to any other pocket of said plurality. Also, each pocket is mountable onto an extrusion which can be inserted into a slat of a slat wall or may be secured to any substantially smooth surface using any suitable means, such as adhesives or screws for example. In this way, each pocket is capable of either being displayed in a side-to-side or top-to-bottom full-face fashion, or in an overlapping step fashion, with no modification to each pocket being necessary. Therefore, the present invention represents a significant improvement over the prior art, as it allows for flexibility in displaying paint chips.

Figure 1:
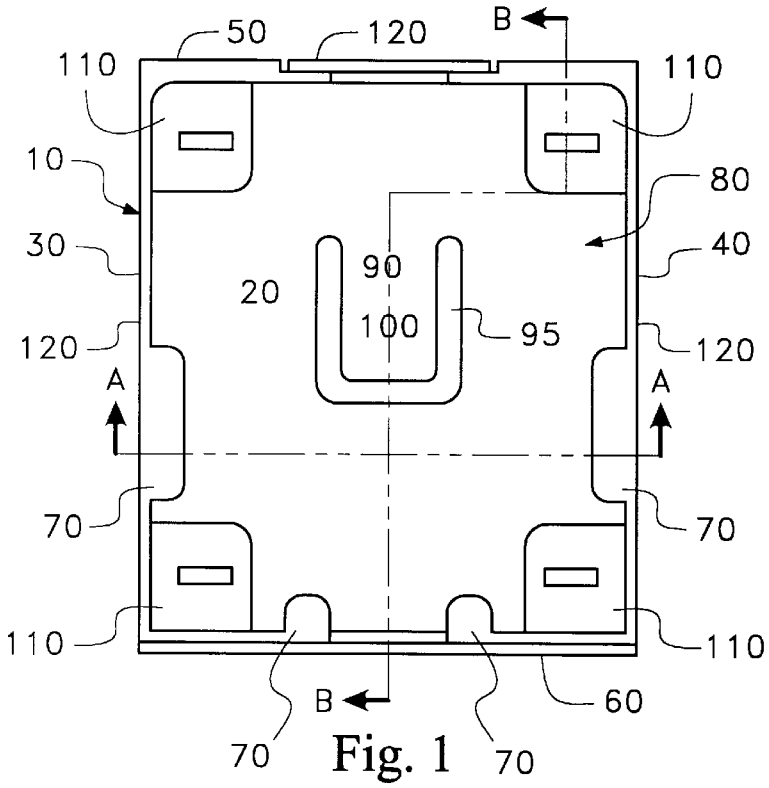
FIG. 1 is a front view of a preferred embodiment of a paint chip display pocket according to the present invention.

More particularly, referring to the figures, wherein like references refer to like parts throughout the several figures, FIG. 1 illustrates a front view of a preferred embodiment of a paint chip display pocket 10 according to the present invention.

Figure 1B:
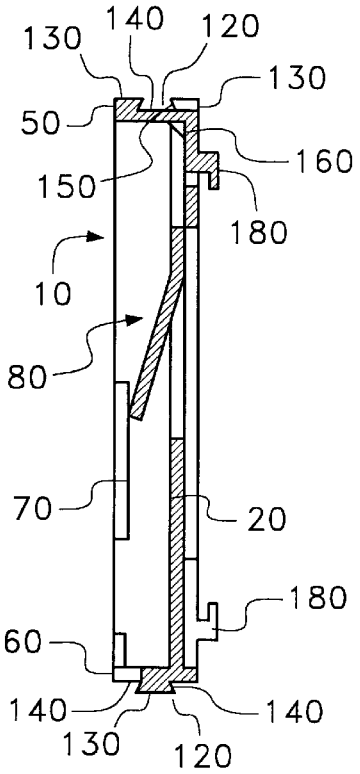
FIG. 1B is a view on cross-section B—B of FIG. 1.
Figure 1A:
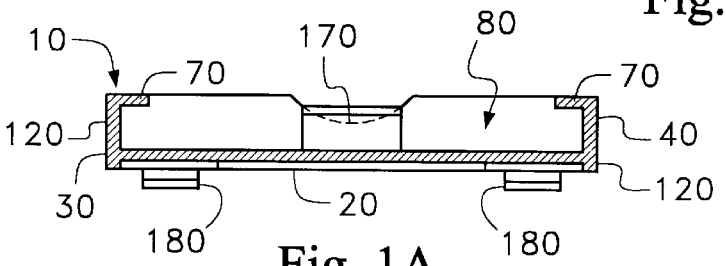
FIG. 1A is a view on cross-section A—A of FIG. 1.

Referring to FIGS. 1, 1A and 1B, in a preferred embodiment Pocket 10 according to the present invention comprises a rear wall 20, oppositely disposed side walls 30 and 40, oppositely disposed top and bottom walls 50 and 60, and retention tabs 70 forming a paint chip cavity 80. The cavity 80 is of suitable size for holding a plurality of paint chips in a front-to-back stacked manner.

In a preferred embodiment the paint chip display pocket 10 is substantially clear or transparent. In a particularly preferred embodiment the paint chip display pocket 10 is made of clear thermoformed, extruded or molded plastic resins.

Biasing means 90 is for biasing paint chips contained within the cavity 80 away from the rear wall 20, and toward retention tabs 70 to facilitate their easy removal by a potential paint customer.

In a preferred embodiment, said biasing means 90 comprises at least one U-shaped incision 95 in said rear wall 20 forming a bent biasing tab 100 in the center thereof which partially protrudes into the cavity 80.

The backside of rear wall 20 includes sample retaining tabs 110. These sample retaining tabs 110 retain at least one "permanent" paint chip representative of the paint chips contained within the cavity 80 behind the rear wall 20. Retaining at least one "permanent" paint chip behind the rear wall 20 prevents potential paint customers from attempting to remove the last paint chip of a given color and finish, thereby ensuring future potential paint customers will be able to view the representative paint chip even before the supply has been replenished.

In the preferred embodiment of FIG. 1, the sample retention tabs 110 are substantially rectangular in shape, and situated near the corners of rear wall 20. However, any configuration which adequately secures at least one paint chip representative of those to be contained within the cavity 80 to the back of rear wall 20 will suffice.

This embodiment of the current invention allows each pocket 10 to either be free standing or coupled to other like pockets as will be described next.

In the preferred embodiment of FIG. 1, the top and bottom walls 50 and 60, respectively include interlocking means 120 on their outer sides, oppositely disposed from said cavity 80, for coupling paint chip display pocket 10 to other like paint chip display pockets. The interlocking means 120 on top wall 50 of all paint chip display pockets 10 according to the present invention are identical in form. Similarly, the interlocking means 120 on bottom wall 60 of all paint chip display pockets 10 according to the present invention are identical in form. Further, the interlocking means 120 of top wall 50 is the mate of interlocking means 120 of bottom wall 60. This allows a paint chip display pocket 10 to be coupled to any other like paint chip display pocket in a top-to-bottom fashion, with the interlocking means 120 of top wall 50 of paint chip display pocket 10 coupling to interlocking means 120 of bottom wall 60 of any other paint chip display pocket according to the present invention.

More particularly, referring to this same preferred embodiment, the interlocking means 120 comprises at least one protrusion 130 forming at least one gap 140, both having angled edges 150, where the at least one protrusion 130 of the top wall 50 is engageable with the at least one gap 140 of the bottom wall 60, and the at least one protrusion 130 of the bottom wall 60 is engageable with the at least one gap 140 of the top wall 50 such that the angled edges 150 adequately couple the two paint chip display pockets together.

Alternatively, the side walls 30 and 40, respectively may include interlocking means 120 on their outer sides, oppositely disposed from said cavity 80, for coupling paint chip display pocket 10 to other like paint chip display pockets similarly as to those discussed for top and bottom walls 50 and 60, respectfully. The interlocking means 120 on side wall 30 of all paint chip display pockets according to the present invention are identical in form. Similarly, the interlocking means 120 on side wall 40 of all paint chip display pockets according to the present invention are identical in form. Further, the interlocking means 120 of side wall 30 is the mate of interlocking means 120 of side wall 40. This allows a paint chip display pocket 10 to be coupled to any other like paint chip display pocket in a side-by-side fashion, with the interlocking means 120 of side wall 30 of paint chip display pocket 10 coupling to interlocking means 120 of side wall 40 of any other paint chip display pocket according to the present invention.

More particularly, referring to this preferred embodiment, the interlocking means comprises at least one protrusion 130 forming at least one gap 140, both having angled edges 150, where the at least one protrusion 130 of the side wall 30 is engageable with the at least one gap 140 of the side wall 40, and the at least one protrusion 130 of the side wall 40 is engageable with the at least one gap 140 of the side wall 30 such that the angled edges 150 adequately couple the two pockets together.

Further yet, in a third preferred embodiment the paint chip display pocket 10 may incorporate interlocking means 120 on both the top/bottom walls (50/60) and side walls (30/40) as discussed in the immediately preceding two preferred embodiments. The interlocking means of the top/bottom walls (50/60) may or may not be substantially identical to the interlocking means 120 of the side walls (30/40). Additionally, the interlocking means could comprise of a repeated pattern of protrusions and gaps, or of a pattern of protrusions and gaps which is not repeated on any single side.

Alternatively, each protrusion 130 may be formed in the shape of a T and hence not include angled edges 150. In this alternative embodiment, each gap 140 is adapted to slidably receive and hence couple to each T shaped protrusion 130.

Figure 9A:
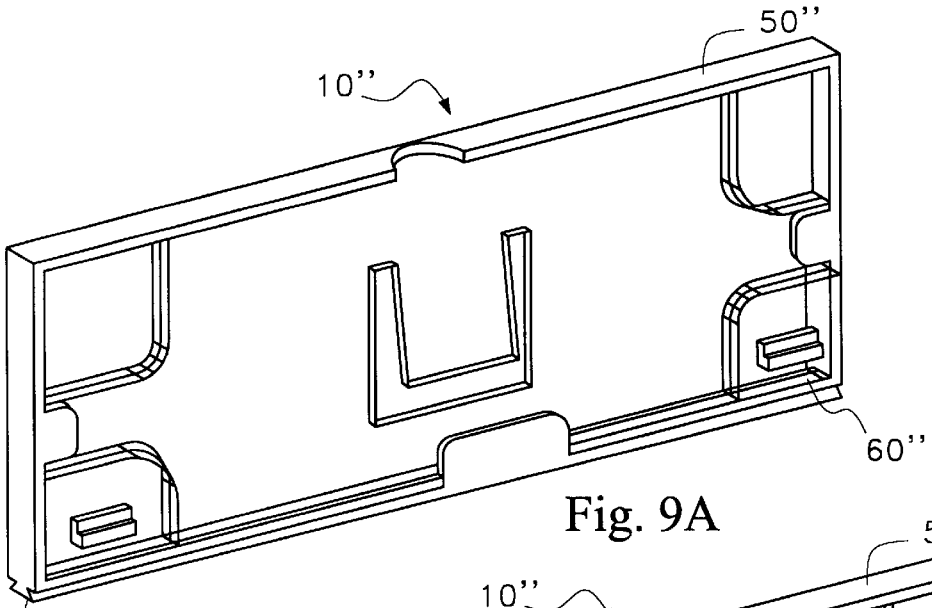
FIG. 9A is a perspective front view of another alternative embodiment of a paint chip display pocket according to the present invention.
Figure 9B:
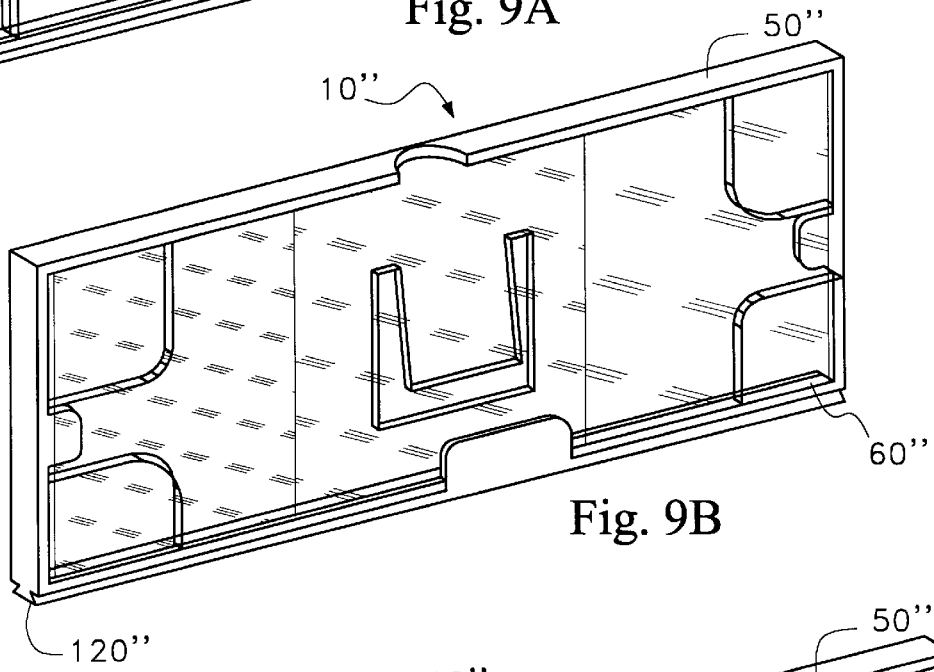
FIG. 9B is a perspective front view of the alternative embodiment of a paint chip display pocket according to the present invention of FIG. 9A including a permanent paint chip.
Figure 9C:
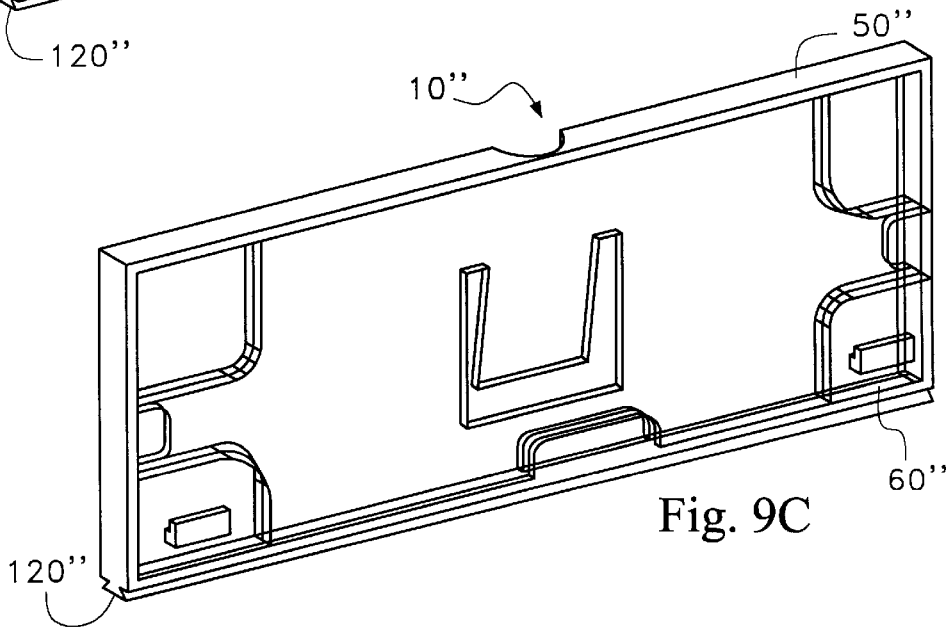
FIG. 9C is a perspective rear view of the alternative embodiment of a paint chip display pocket according to the present invention of FIG. 9A.

Referring now to FIGS. 9A–9C, in an alternative embodiment, each pocket 10" includes interlocking means 120" on an odd number of sides. Preferably, interlocking means 120 " are at least included on the bottom 60" of each pocket 10" for coupling each pocket 10" to an extrusion 190 (as set forth below).

Figure 10A:
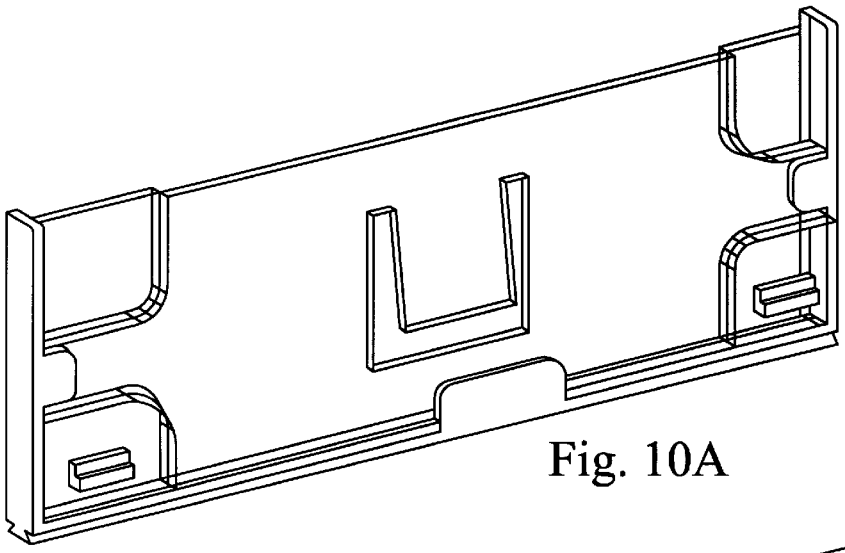
FIG. 10A is a perspective front view of another alternative embodiment of a paint chip display pocket according to the present invention.
Figure 10B:
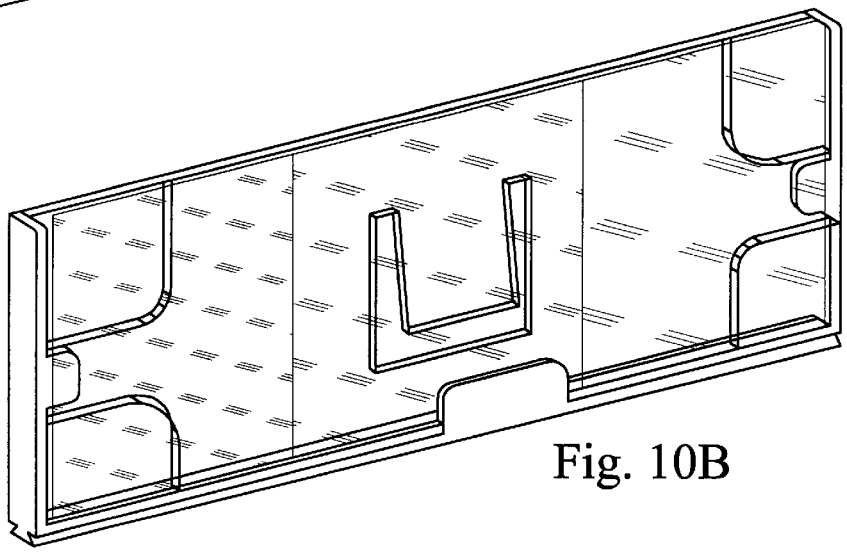
FIG. 10B is a perspective front view of the alternative embodiment of a paint chip display pocket according to the present invention of FIG. 10A including a permanent paint chip.
Figure 10C:
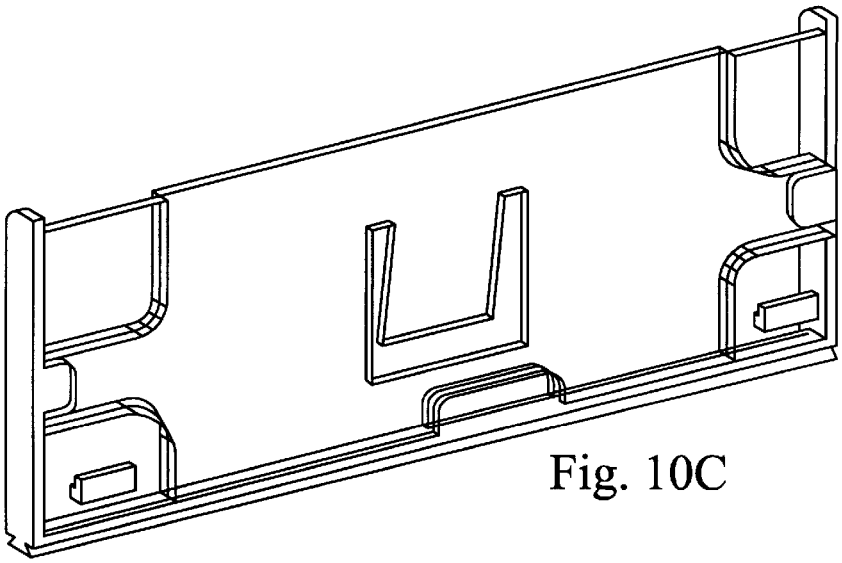
FIG. 10C is a perspective rear view of the alternative embodiment of a paint chip display pocket according to the present invention of FIG. 10A.

Also alternatively, as illustrated in FIGS. 10A–10C, each pocket 10'" does not include an upper wall 50'" being located opposite bottom wall 60'" and interlocking means 120'".

Referring to the preferred embodiment of FIG. lB, a beveled edge 160 is within cavity 80, between the rear wall 20, and the top wall 50. This beveled edge 160 allows a prospective paint purchaser to more easily remove a paint chip contained within the cavity 80.

Figure 2A:
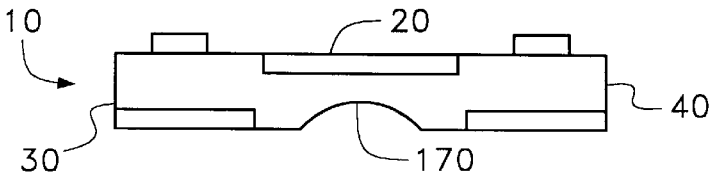
FIG. 2A is a top elevational view of the preferred embodiment of the present invention according to the present invention.
Figure 2B:
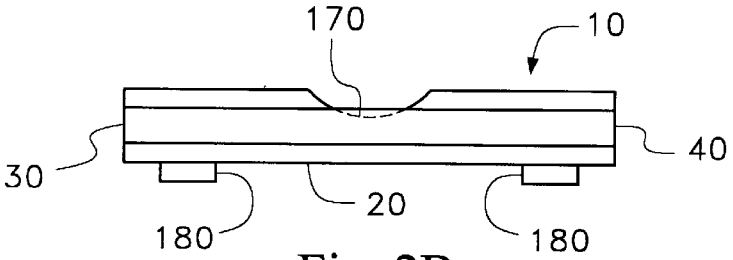
FIG. 2B is a bottom elevational view of the preferred embodiment of the present invention according to the present invention.

In the preferred embodiment of FIGS. 2A and 2B, thumb indentations 170 are disposed in the top wall 50 and bottom wall 60 to allow a prospective paint purchaser to more easily remove a paint chip contained within the cavity 80. In a particularly preferred embodiment, these indentations have an arcuate or arc-like shape.

Figure 3:
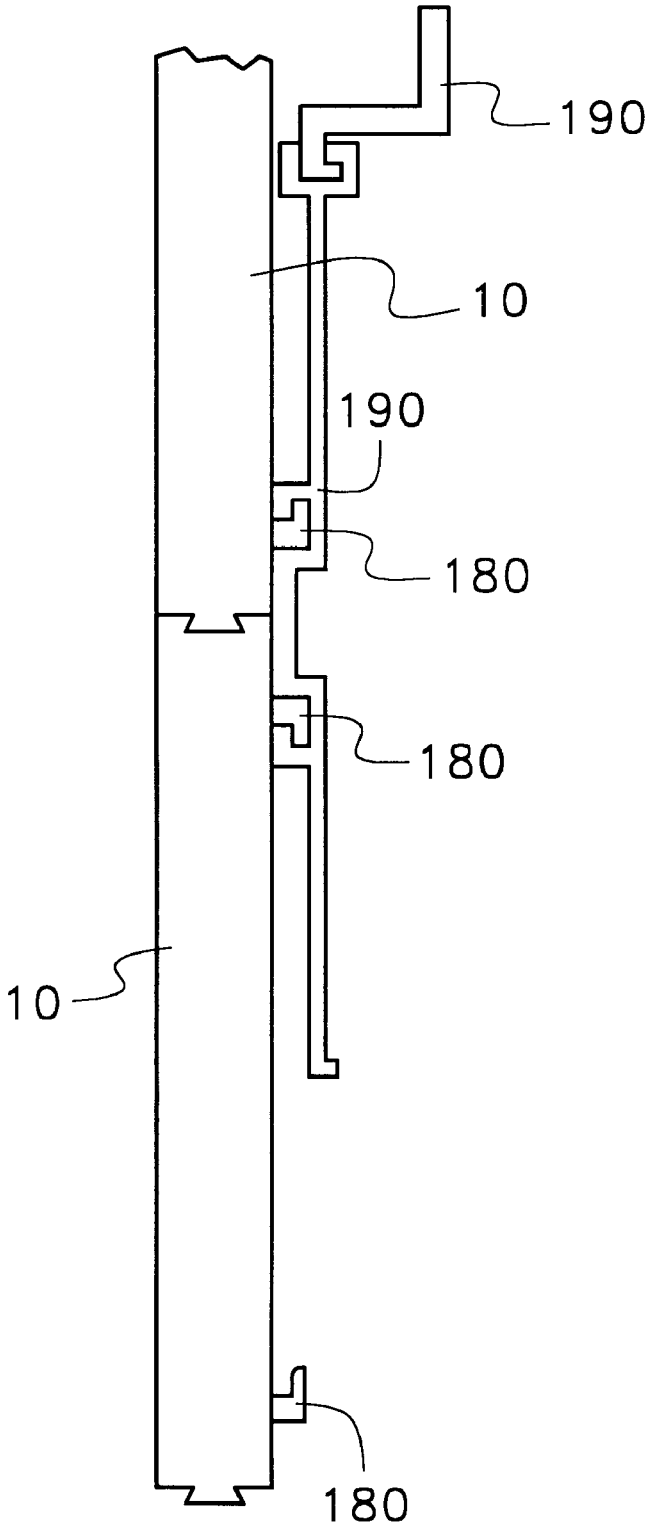
FIG. 3 is a side view of the preferred embodiment of a paint chip display unit according to the present invention mounted to a wall.
Figure 4:
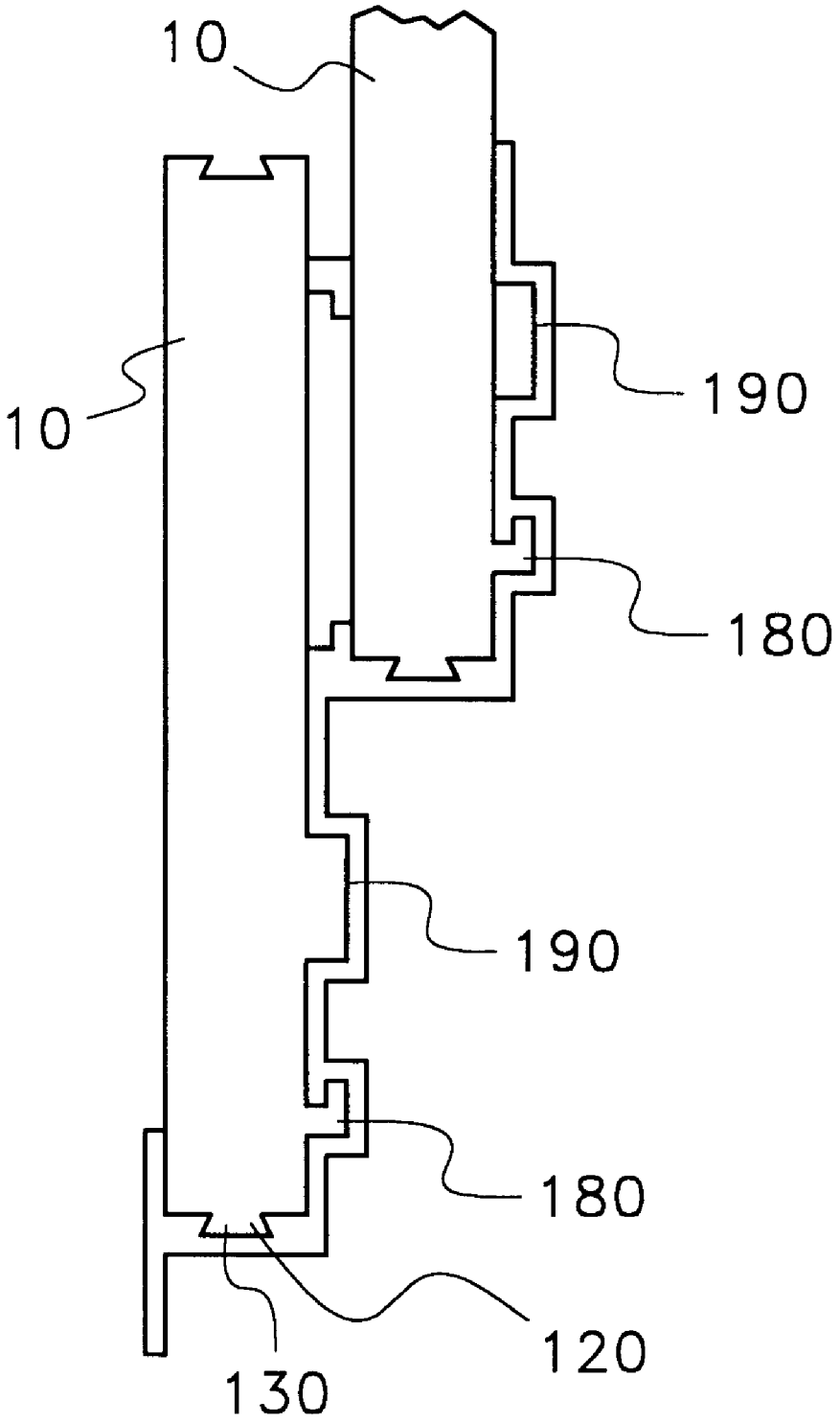
FIG. 4 is a side view of the paint chip display system according to the present invention utilizing an extrusion profile.

In a preferred embodiment, referring now to FIGS. 2A, 2B and 3, L-hooks 180 are for slidably coupling the pocket 10 to an extrusion 190 and are positioned on the backside of rear wall 20 oppositely disposed from said cavity 80. Each L-hook 180 has a portion substantially parallel to rear wall 20 and is of suitable size and strength to couple pocket 10 to extrusion 190. However, any mounting means of suitable strength and configuration for removably coupling the pocket 10 to extrusion 190 will suffice.

In a preferred embodiment, the extrusion 190 is inserted into a slat of a slat wall, or may be secured to any substantially smooth surface using any suitable means, such as adhesives or screws. Each pocket 10 is secured in a non-overlapping manner, allowing for display of the entire face of each stack of paint chips, contained within each pocket 10.

Figure 5:
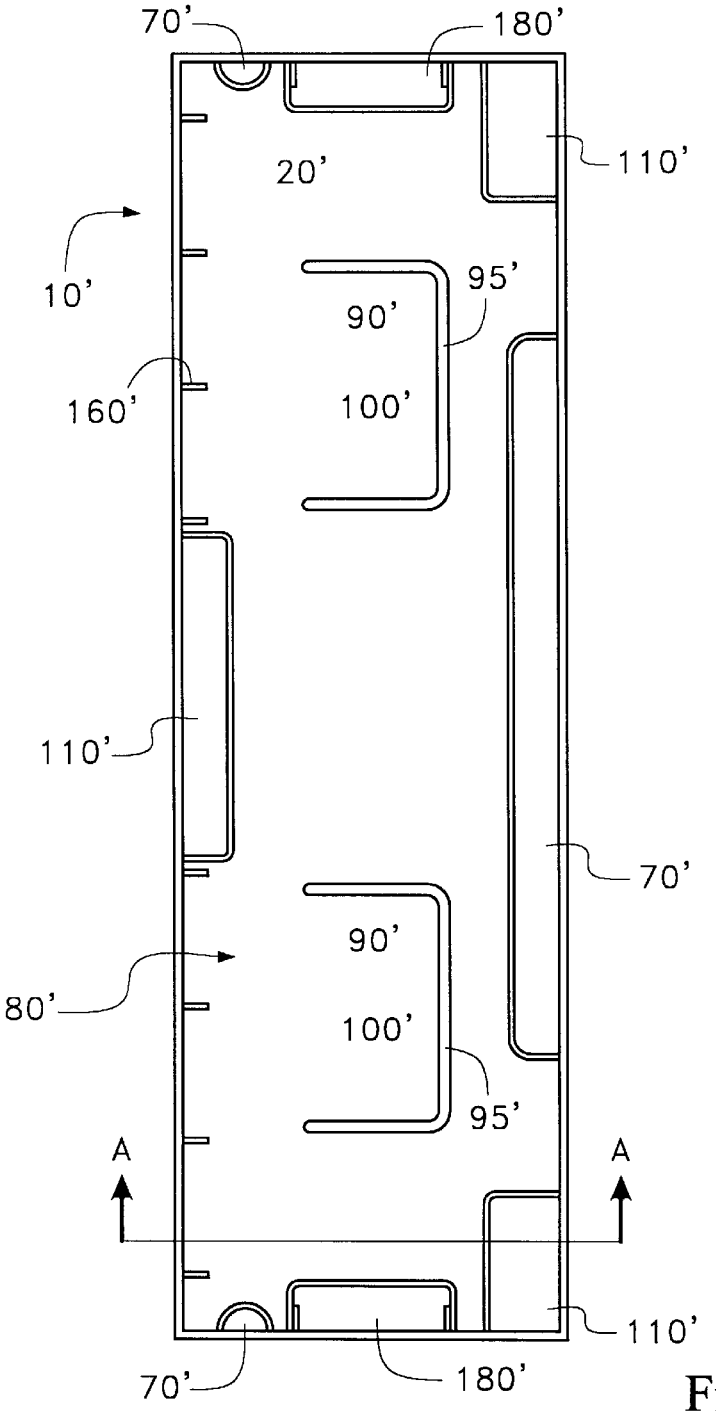
FIG. 5 is a front view of an alternative embodiment of a paint chip display pocket according to the present invention.
Figure 5A:
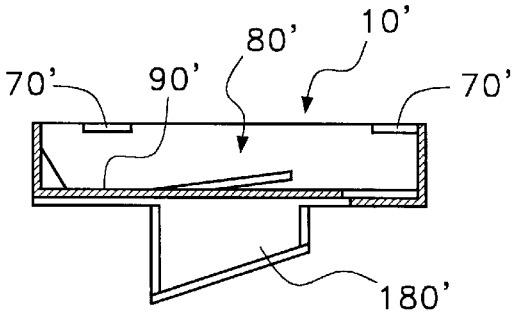
FIG. 5A is a view on cross-section A—A of FIG. 5.

Referring now to FIGS. 5 and 5A, in an alternative embodiment, the pocket 10' is adapted to allow a prospective paint customer to remove paint chips contained within the cavity 80' from the side as opposed to from the top (please note that the elements designated correspond to those equivalently numbered elements of FIG. 1). As illustrated by FIG. 5, the biasing means 90' of pocket 10' includes two generally u-shaped incisions 95' in the rear wall 20' forming two bent biasing tabs 100' which partially protrude into the cavity 80' of the pocket 10'. The sample tabs 110' in this embodiment of the present invention include three tabs located behind the rear wall 20', two near the corners of the pocket 10' corresponding to the side wall 40', and the third located substantially near the center of the opposite side wall 30'.

Further, the pocket 10' includes three retention tabs 70', two of which are substantially semi-circular and the third of which is substantially rectangular.

In an alternative embodiment, referring now to FIGS. 4, 6A–6D and 7A–7F, extrusion 190 secures each pocket 10 or 10' according to the present invention as hereto described in a manner partially overlapping, or stepped configuration with, at least one other identical pocket 10 or 10', respectively. Accordingly, the overall area required by the paint chip display can be reduced, although portions of the paint chips faces will now be obscured. In the particularly preferred embodiment each pocket 10 or 10' permits a displayor to either display the paint chips in a manner which presents their full face, or in a stepped configuration, without modifying each respective pocket 10 or 10', depending upon the physical confines of the area in which the display is to be placed.

As illustrated by FIGS. 4, 5A, 6C and 7 the L-hooks 180 and corresponding portion of the extrusion 190 provide means for mounting each pocket 10 or 10' according to the present invention in an angled, overlapping (IE. stepped) configuration to reduce the required space for the entire display. If the pocket according to the present invention is configured to allow for removal of paint chips contained within the cavity 80 upwardly and forwardly (as illustrated in FIG. 1), then it is preferred for the pockets 10 to overlap vertically (as illustrated in FIGS. 7A–7F). If the pocket according to the present invention is configured to allow for removal of paint chips contained within the cavity 80' from a side (as illustrated in FIG. 5 for example), then it is preferred for the pockets 10' to overlap in a side to side manner (as illustrated in FIGS. 6A–6D).

Figure 11:
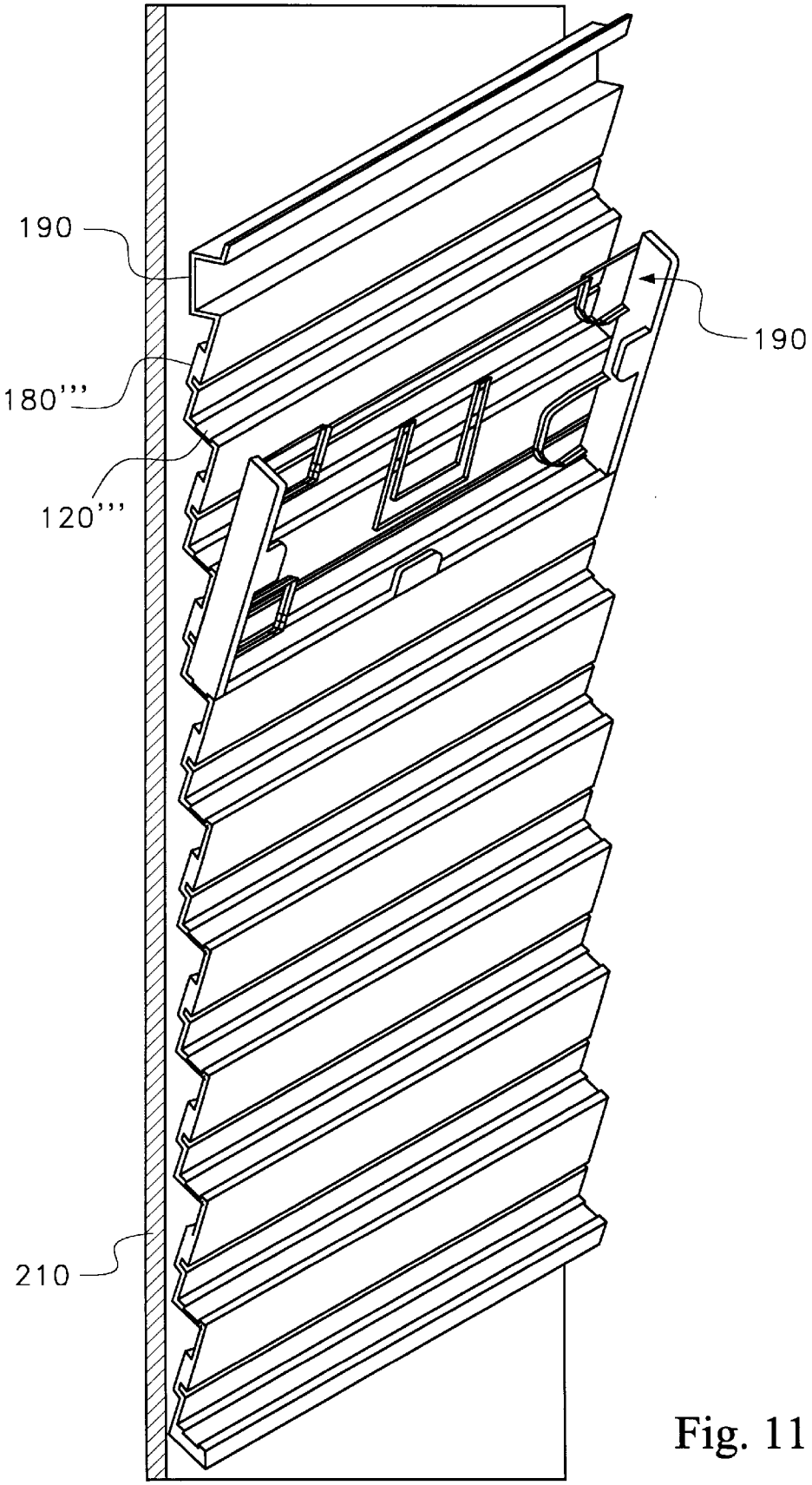
FIG. 11 is a perspective front view of the alternative embodiment of a paint chip display pocket according to the present invention of FIG. lOA coupled to an extrusion according to the present invention.

Alternatively, as illustrated in FIG. 11 only some of the L-hooks 180, preferably those positioned in the lower half of each pocket according to the present invention near bottom wall (60'", or 60'" for example), together with the interlocking means (120'" or 120'" for example) couple to the extrusion 190 to secure each pocket (10'''' or 10'''' for example) thereto in a partially overlapping manner.

Figure 7A:
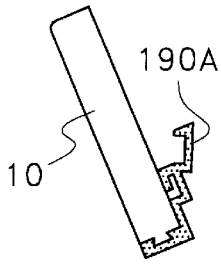
FIGS. 7A–7F are top views of an alternative embodiment of the paint chip display pockets being mounted to an alternative extrusion according to the present invention.
Figure 7B:
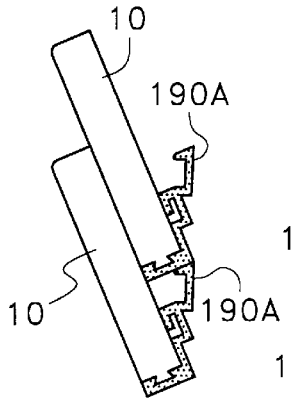
Figure 7C:
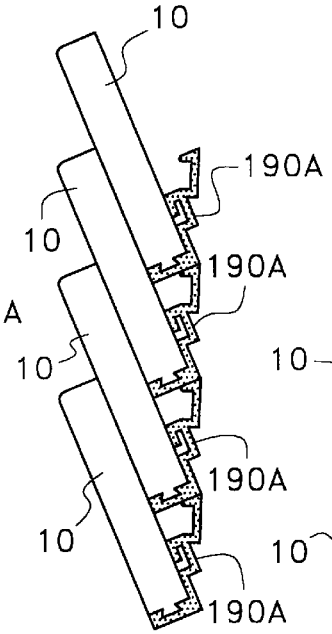

Referring now to FIGS. 7A–7F, each extrusion 190 can be configured to hold any number of pockets in an overlapping manner. For example in FIG. 7A, the extrusion 190A is configured to mount a single row of pockets 10. That row may contain any number of pockets 10, limited only by the length of the extrusion 190 and the physical limitations of the surface to which the extrusion 190A is to be mounted. Referring now also to FIGS. 7B and 7C, multiple rows of pockets 10 can be mounted upon a surface utilizing the single row extrusion 190A of FIG. 7A by mounting another extrusion 190A above or below the first extrusion 190A. Utilizing this configuration, the overall horizontal and vertical dimensions of the overlapping display containing a plurality of pockets 10 can be varied, thus providing greater flexibility in the system according to the present invention.

Figure 7D:
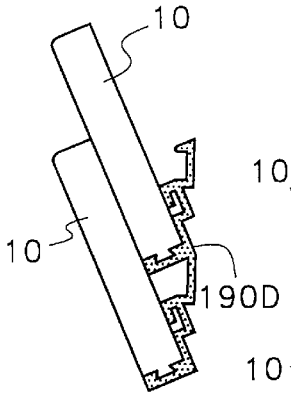
Figure 7E:
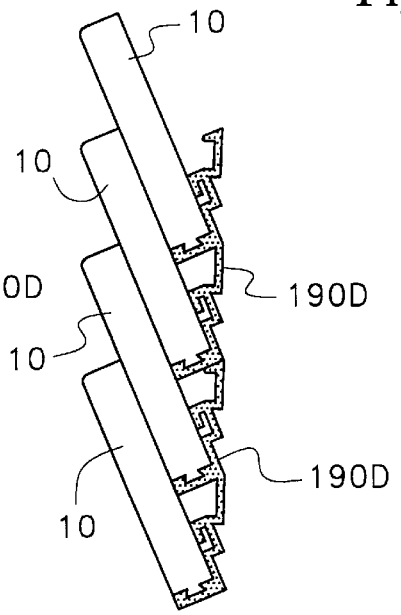

Referring now to FIG. 7D, therein is shown an extrusion 190D according to the present invention which provides mounting for two rows of pockets 10. Again the length of the rows are determined by the length of the extrusion 190D and the physical limitations of the surface upon which it is to be mounted. Referring now also to FIG. 7E, as seen within FIGS. 7B and 7C, multiple extrusion 190D can be mounted in a top-to-bottom fashion in order to provide a display containing the pockets 10 having the desired vertical dimension.

Figure 7F:
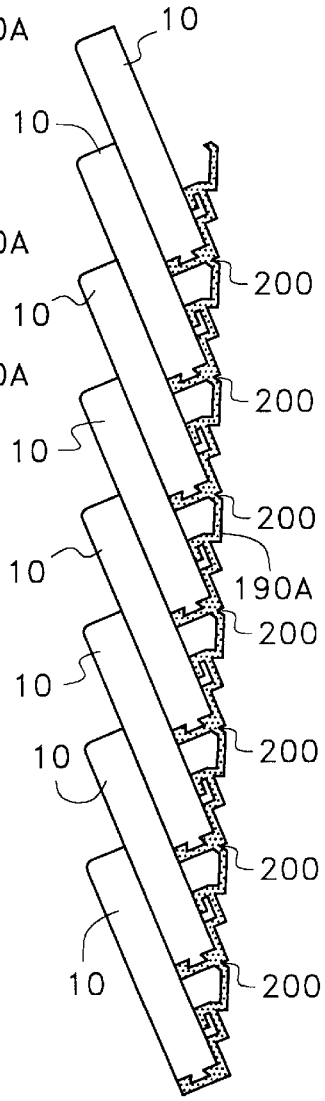

Referring now to FIG. 7F, therein is shown an extrusion 190F according to the present invention which provides mounting for eight rows of pockets 10. Again the length of the rows are determined by the length of the extrusion 190F and the physical limitations of the surface upon which it is to be mounted. Again, as seen within FIGS. 7B, 7C and 7E, multiple extrusion 190F can be mounted in a top-to-bottom fashion in order to provide a display containing the pockets 10 having the desired vertical dimension. Preferably, the extrusion 190F includes separating notches 200 which provide means for separating each row of pockets 10 from the others. In this way the extrusion 190F can be broken up to create extrusions 190A or 190D for example. Therefore, the present invention provides yet even greater flexibility in providing a display system capable of having varying dimensions and being customizable to the physical space in which it is to be mounted.

In another alternative embodiment, the extrusions (190D and 190F for example) may be configured such that different rows within each extrusion accept different size paint chips.

Figure 8A:
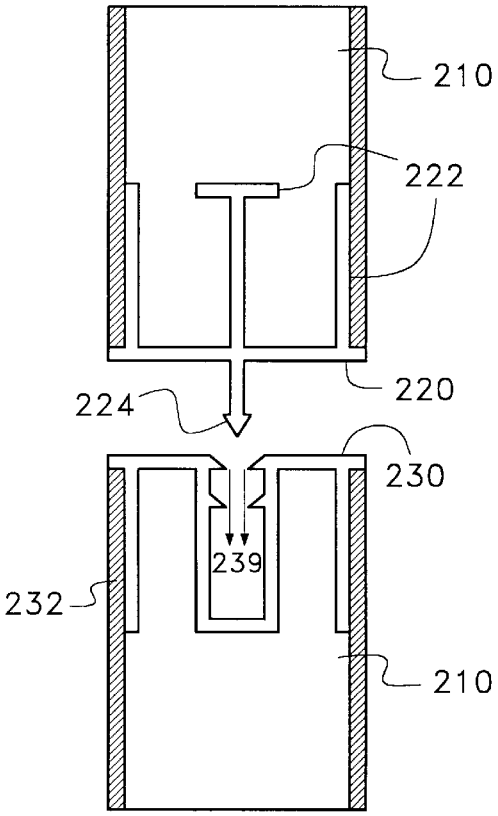
FIGS. 8A–8D are side views of a preferred embodiment of connectors for coupling extrusions together.
Figure 8C:
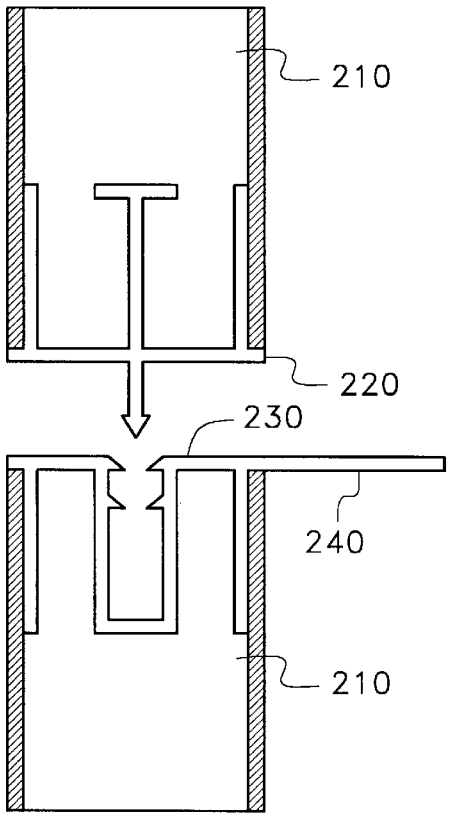
Figure 8B:
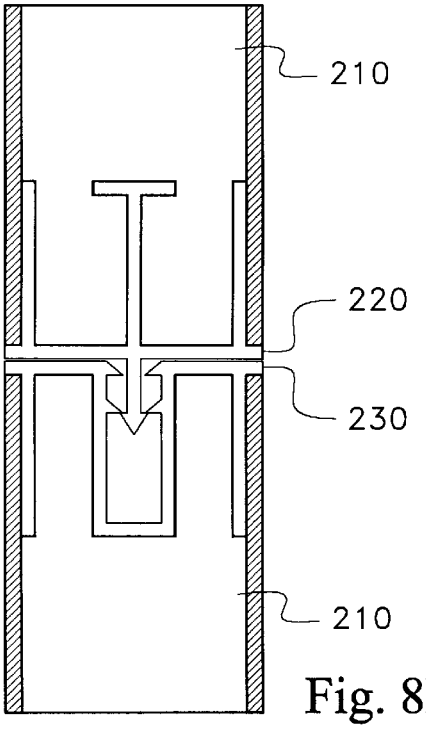

Referring now also to FIGS. 11, 8A and 8B, in an alternative embodiment, the extrusions (190, 190A–190F) are coupled to mounting board 210 using suitable means (for example glue, tacks . . . ). Multiple mounting boards 210 can be affixed or coupled together using any suitable means to provide a display of the desired dimensions.

Preferably however, multiple boards 210 are coupled together using pin inserts 220 and 230. The pin inserts are removably coupled by a displayor such that the pin insert 220 engages with the pin insert 230. Preferably the pin insert 220 is the male element including means 222 for anchoring such to a first board 210, and engagement means 224 for engaging the pin insert 230. Preferably the pin insert 230 is the female element and includes means 232 for anchoring such to a second board 210, and engagement means 234 for engaging the engagement means 224 of the pin insert 220.

Figure 8D:
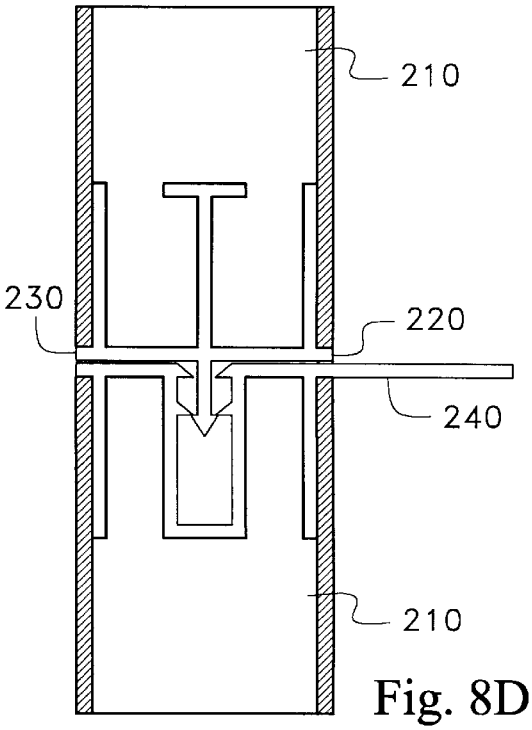

Referring now to FIGS. 8C and 8D, alternatively the pin insert 230 may further include and extension 240, wherein the extension 240 provides a lip at one end of the board 210. This lip formed by the extension 240 is preferably of suitable size and strength to prevent the inadvertent or unauthorized removal or excessive shifting of pockets (10 or 10') according to the present invention coupled to an extrusion (190, 190A–F) mounted to a board 210.

Although the invention has been described in a preferred form with a certain degree of particularity, it is understood that the present disclosure of the preferred form has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

I claim:

1. A paint chip display device comprising a rectangular container, said container comprising:

a rectangular rear wall having a front surface and a back surface;

an open front face oppositely disposed from said rectangular rear wall;

oppositely disposed upper and lower walls, coupled between said rear wall and said front face;

oppositely disposed left-side and right-side walls, coupled between said rear wall and said front face;

retaining means for retaining paint chips contained within a cavity formed by said rear, upper, lower, left-side and right-side walls; and, biasing means for biasing paint chips contained within said cavity away from said rear wall and toward said open front face.

2. The device of claim 1, wherein said biasing means is integrally formed into said back wall.

3. The device of claim 2, wherein said biasing means comprises at least one incision in said rear wall forming a bent biasing tab.

4. The device of claim 1, wherein said retaining means comprises at least one retention tab partially obstructing said open face.

5. The device of claim 4, wherein said at least one retention tab is fixed and not moveable with respect to said rear wall and is coupled to at least one of said upper, lower, right-side and left-side.

6. The device of claim 4, wherein said at least one retention tab is rounded on at least one end to facilitate easy removal of paint chips from said cavity.

7. The device of claim 4, wherein said at least one retention tab comprises at least one retention tab disposed on the left-side wall, at least one retention tab disposed on the right-side wall, each being disposed opposite from said rear wall, respectively, and at least one retention tab disposed on the bottom wall opposite from said rear wall, each being substantially even to said open front face, respectively.

8. The device of claim 1, further comprising sample holding means for securing a sample paint chip which can not be removed by a prospective paint customer.

9. The device of claim 8, wherein said sample holding means comprises sample retaining tabs positioned behind said rear wall, for securing said sample paint chip adjacent to said back surface of said rear wall.

10. The device of claim 1, further comprising interlocking means on outer surfaces of at least one pair selected from the group consisting of said top and bottom walls, and said left-side and right-side walls, for coupling the paint chip device to at least one other identical paint chip device.

11. The device of claim 10, wherein said interlocking means of said oppositely disposed walls mate only with each other.

12. The device of claim 11, wherein said interlocking means comprise at least one protrusion having at least one angled edge.

13. The device of claim 1, wherein said device is made of a clear material.

14. The device of claim 4, wherein said at least one retention tab comprises at least one retention tab disposed on the upper wall, at least one retention tab disposed on the lower wall, and at least one retention tab disposed on the right-side wall, each being substantially even to said open front face, respectively.

15. The device of claim 1, wherein said biasing means and said retaining means are adapted to co-act such that each of said paint chips contained within said cavity is positioned substantially parallel to said rear wall.

16. A paint chip display system comprising:

a plurality of paint chip display rectangular containers each comprising:

a rectangular rear wall having a front surface and a back surface;

an oppositely disposed open front face;

oppositely disposed upper and lower walls, coupled between said rear wall and said front face;

oppositely disposed left-side and right-side walls, coupled between said rear wall and said front face;

retaining means for retaining paint chips contained within a cavity formed by said rear, upper, lower, left-side and right-side walls; and, biasing means for biasing paint chips contained within said cavity away from said rear wall and toward said open front face; and, mounting means for securing said containers to a substantially vertical surface.

17. The system of claim 16, wherein said mounting means comprises means for securing each of said plurality of containers in a non-overlapping manner to a slat-wall.

18. The system of claim 16, wherein said mounting means comprises means for securing each of said plurality of containers in a partially overlapping manner to a slat wall.

19. The system of claim 16; further comprising interlocking means for coupling a first paint chip container selected from said plurality of paint chip display containers to a second paint chip display container selected from said plurality of paint chip display containers.

20. The system of claim 16, wherein said biasing means comprises at least one incision in said rear wall which forms a bent biasing tab.

21. The system of claim 16, wherein said retaining means comprises at least one retention tab partially obstructing said open face which is fixed and not moveable with respect to said rear wall.

22. A paint chip display device comprising a rectangular container, said container comprising:

a substantially rectangular rear wall;

an open front face oppositely disposed from said substantially rectangular rear wall;

a lower wall coupled between said rear wall and said front face;

oppositely disposed left-side and right-side walls, coupled between said rear wall and said front face;

retaining means for retaining paint chips contained within a cavity defined by said rear, left-side, right-side, lower walls and retaining means; and, biasing means for biasing paint chips contained within said cavity away from said rear wall and toward said open front face.

23. The device of claim 22, further comprising interlocking means on outer surfaces of said lower wall and said rear wall for coupling said pocket to a surface.

24. A paint chip display system comprising:

a plurality of paint chip display containers;

mounting means coupled to each of said plurality of containers for securing said containers to a substantially vertical surface;

coupling means for securing said mounting means to other like mounting means, said coupling means comprising:

a protrusion portion having a pointed end;

a receiving portion having a gap for receiving said pointed end of said protrusion portion; and, means for removably securing said pointed end of said protrusion portion within said gap;

wherein said coupling means further comprises means for preventing said plurality of paint chip display containers from being slidably removed from said mounting means.

25. The system of claim 24, wherein said means for preventing said plurality of paint chip display containers from being slidably removed from said mounting means comprises a tab.

26. A paint chip display device comprising a substantially rectangular container, said container comprising:

a substantially rectangular rear wall having a front surface and a back surface;

an open front face oppositely disposed from said rectangular rear wall;

oppositely disposed upper and lower walls, coupled between said rear wall and said front face;

oppositely disposed left-side and right-side walls, coupled between said rear wall and said front face;

retaining means for retaining paint chips contained within a cavity formed by said rear, upper, lower, left-side and right-side walls; and, at least one incision in said rear wall forming a bent biasing tab integrally formed into said rear wall for biasing paint chips contained within said cavity away from said rear wall and toward said open front face.

* * * * *